US008967412B2

(12) United States Patent
Loging

(10) Patent No.: US 8,967,412 B2
(45) Date of Patent: Mar. 3, 2015

(54) DRINKING CUP WITH LID AND FLOW CONTROL ELEMENT

(76) Inventor: James A Loging, Laurens, SC (US)

( * ) Notice: Subject to any disclaimer, the term of this patent is extended or adjusted under 35 U.S.C. 154(b) by 1163 days.

(21) Appl. No.: 12/804,986

(22) Filed: Aug. 3, 2010

(65) Prior Publication Data

US 2012/0031917 A1 Feb. 9, 2012

(51) Int. Cl.

| | |
|---|---|
| ***B65D 51/16*** | (2006.01) |
| ***B65D 85/72*** | (2006.01) |
| ***A61J 9/00*** | (2006.01) |
| ***A61J 7/00*** | (2006.01) |
| ***A47G 19/22*** | (2006.01) |

(52) U.S. Cl.

CPC ..... *A47G 19/2272* (2013.01)

USPC ..... 220/203.01; 220/714; 220/203.17; 220/203.18; 215/11.4; 215/11.5; 215/260; 215/309; 215/310; 206/219; 222/145.1; 222/145.5

(58) Field of Classification Search

USPC ..... 220/203.01, 303, 714, 521, 913, 220/203.17, 203.18, DIG. 27; 215/11.4, 215/11.5, 11.1, 260, 270, 309, 310, 311, 215/387, DIG. 3, DIG. 8, 6; 206/219, 221, 206/828; 222/129, 145.1, 145.5; 604/78; 119/51.5, 51.01, 71

See application file for complete search history.

(56) References Cited

U.S. PATENT DOCUMENTS

| | | | |
|---|---|---|---|
| 1,418,814 | A | 6/1922 | Lutz et al. |
| 3,302,644 | A | 2/1967 | Kennedy |
| 4,006,841 | A | 2/1977 | Alticosalian |
| 4,773,562 | A | 9/1988 | Gueret |
| 4,856,995 | A | 8/1989 | Wagner |
| 4,969,579 | A | 11/1990 | Behar |
| 5,029,701 | A | 7/1991 | Roth et al. |
| 5,033,655 | A | 7/1991 | Brown |
| 5,213,236 | A | 5/1993 | Brown |
| 5,234,117 | A | 8/1993 | Garvin |
| 5,244,122 | A | 9/1993 | Botts |
| 5,269,425 | A | 12/1993 | Gomez-Acevedo |
| 5,339,995 | A | 8/1994 | Brown |
| 5,353,964 | A | 10/1994 | Liu |

(Continued)

FOREIGN PATENT DOCUMENTS

| | | |
|---|---|---|
| GB | 1034528 | 6/1966 |

OTHER PUBLICATIONS

United States Patent and Trademark Office; Office Action from U.S. Appl. No. 10/846,799 now US Pat. No. 7,108,676 B2; mailed Apr. 7, 2006; Alexandria, Virginia; pp. 1-7; copy enclosed (7 pages).

(Continued)

*Primary Examiner* — Fenn Mathew
*Assistant Examiner* — Jennifer Castriotta
(74) *Attorney, Agent, or Firm* — Neal P Plerott; Metz Lewis Brodman Must O'Keefe

(57) ABSTRACT

A drinking cup that has a lid with a receiving portion is provided. The receiving portion may have a flow control engagement surface. A flow control element that may be configured for releasable attachment with the lid may be included and can have an attachment portion. The attachment portion may have a lid engagement surface. When the flow control element and the lid are attached, the flow control engagement surface engages the lid engagement surface. At least one of the flow control engagement surface and the lid engagement surface may have a concave shape.

15 Claims, 7 Drawing Sheets

(56) References Cited

U.S. PATENT DOCUMENTS

| | | | | |
|---|---|---|---|---|
| 5,377,877 | A | 1/1995 | Brown | |
| 5,383,906 | A | 1/1995 | Burchett et al. | |
| 5,409,144 | A * | 4/1995 | Brown | 222/185.1 |
| 5,439,143 | A | 8/1995 | Brown | |
| 5,487,750 | A | 1/1996 | Burchett et al. | |
| 5,542,670 | A * | 8/1996 | Morano | 220/714 |
| 5,611,776 | A | 3/1997 | Simmons | |
| 5,620,462 | A | 4/1997 | Valenti | |
| 5,706,973 | A | 1/1998 | Robbins | |
| 5,890,621 | A | 4/1999 | Bachman | |
| 5,897,007 | A | 4/1999 | Schein et al. | |
| 5,938,053 | A * | 8/1999 | Verbovszky et al. | 215/6 |
| 6,050,445 | A | 4/2000 | Manganiello | |
| 6,095,382 | A * | 8/2000 | Gross | 222/520 |
| 6,126,679 | A | 10/2000 | Botts | |
| 6,176,399 | B1 * | 1/2001 | Schantz et al. | 222/484 |
| 6,230,940 | B1 * | 5/2001 | Manning et al. | 222/185.1 |
| 6,270,519 | B1 | 8/2001 | Botts | |
| 6,273,296 | B1 * | 8/2001 | Brown | 222/92 |
| 6,422,415 | B1 | 7/2002 | Manganiello | |
| 6,915,961 | B2 | 7/2005 | Renz | |
| 6,981,962 | B1 | 1/2006 | Lenkersdorf | |
| 7,108,676 | B2 | 9/2006 | Loging | |
| D584,102 | S | 1/2009 | Valderrama | |
| 7,753,226 | B2 | 7/2010 | Chauvin | |
| 7,991,745 | B2 | 8/2011 | Brown | |
| 2001/0020623 | A1 | 9/2001 | McDonough | |
| 2002/0063103 | A1 | 5/2002 | Kiernan | |
| 2002/0074338 | A1 | 6/2002 | Manganiello | |
| 2003/0192911 | A1 | 10/2003 | Jacobs | |
| 2004/0006303 | A1 | 1/2004 | Takowsky | |
| 2005/0072788 | A1 * | 4/2005 | Lieberman et al. | 220/714 |
| 2005/0247719 | A1 * | 11/2005 | Loging | 220/714 |
| 2008/0283537 | A1 * | 11/2008 | Smith et al. | 220/713 |
| 2011/0056968 | A1 * | 3/2011 | McNamara et al. | 220/714 |
| 2011/0079570 | A1 * | 4/2011 | Brown et al. | 215/11.4 |

OTHER PUBLICATIONS

United States Patent and Trademark Office; Office Action from U.S. Appl. No. 10/846,799 now US Pat. No. 7,108,676 B2; mailed Feb. 13, 2006; Alexandria, Virginia; pp. 1-7; copy enclosed (7 pages).

United States Patent and Trademark Office; Office Action from U.S. Appl. No. 13/527,118; mailed Oct. 3, 2014; Alexandria, Virginia; pp. 1-9; (9 pages).

* cited by examiner

DRINKING CUP WITH LID AND FLOW CONTROL ELEMENT

FIELD OF THE INVENTION

The present invention relates generally to drinking cups. More particularly, the present application involves a drinking cup that features an enhanced connection between a lid and a flow control element of the drinking cup to help prevent these components from being inadvertently disengaged.

BACKGROUND

Drinking cups with lids are commonly used by children for the dispensing of a beverage. These types of cups usually employ a valve arrangement that prevents the beverage from being dispensed from the drinking cup if the cup is turned upside down or dropped by the child. One or more valves are incorporated into a flow control element that can be attached and detached from the bottom of the lid of the drinking cup. The flow control element can be removed from the lid to allow the drinking cup to be more thoroughly cleaned.

The flow control element includes side walls that are straight that frictionally engage corresponding straight side walls of the lid. Although capable of effecting an attachment of these components, forces imparted onto the drinking cup may be sufficient to dislodge the flow control element from the lid thus allowing beverage to leak inadvertently from the drinking cup. For example, if the child drops the drinking cup the flow control element may become disengaged from the lid thus allowing beverage to flow from the drinking cup without being contained by the valve of the flow control element.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
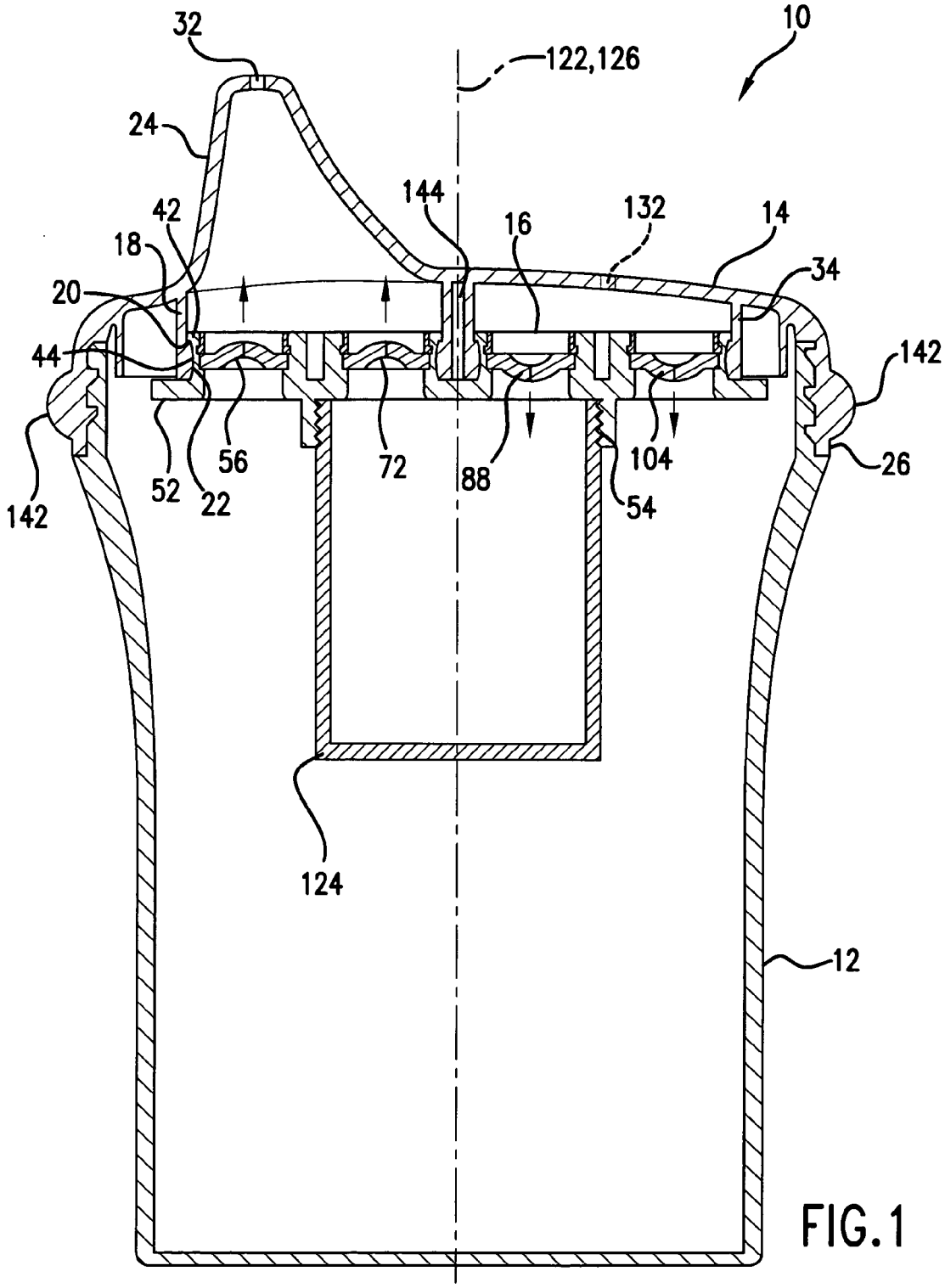
FIG. 1 is a cross-sectional view of an assembled drinking cup in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a drinking cup 10 that features a lid 14 that is releasably attached to a flow control element 16. The releasable attachment may be arranged so that when attached it is secure enough to remain attached even when one drops the drinking cup 10. As such, the releasable attachment may be effected so that it only becomes disengaged when one desires it to become disengaged. The releasable attachment may include a flow control element 16 that has an attachment portion 40 with a projection 42 and a lid engagement surface 44 that has a concave shape. The lid 14 may have a receiving portion 14 that features a projection receiving surface 20 and a flow control engagement surface 22 that has a convex shape. The flow control element 16 can be attached to the lid 14 such that the projection 42 engages the projection receiving surface 20 and such that the lid engagement surface 44 engages the flow control engagement surface 22. This type of connection may allow for the lid 14 and flow control element 16 to be more securely attached to one another and removable only upon the intentional application of force to these components.

FIG. 1 illustrates a drinking cup 10 in accordance with one exemplary embodiment. The drinking cup 10 includes a cup body 12 that is attached to a lid 14 through a releasable attachment. The cup body 12 has a longitudinal axis 12 that extends through its center. The drinking cup 10 may also feature a medicine cup 124 that likewise has a longitudinal axis 126 through its center. The drinking cup 10 may be arranged so that the longitudinal axes 122 and 126 are coaxial with one another. This arrangement may prevent the flow control element 16 or other components from disengaging should the drinking cup 10 be inadvertently dropped or hit because the weight of the medicine cup 124 and its contents are located at the center of the drinking cup 10 and not off-center thus minimizing any unbalanced jarring. However, it is to be understood that other arrangements are possible in which the medicine cup 124 is not at the center of the cup body 12 such that the longitudinal axes 122 and 126 are not coaxial with one another. The medicine cup 124 may be used to hold medicine to be administered to a child. Drinking contents, such as juice, may be located in the cup body 12 and mixed with the medicine upon dispensing by the child thus masking the presence of the medicine in the drink. The amount of medicine administered can be noted since the medicine is kept separate from the juice or other beverage. However, it is to be understood that a medicine cup 124 need not be present in other arrangements, and that the drinking cup 10 of the present invention need not have a medicine cup 124 or be configured in any special manner for the administration of medicine.

The cup body 12 can be releasably attached to the lid 14 through the use of a threaded connection. In the disclosed arrangement, the top of the cup body 12 has external threading that engages internal threading located on a cup body receiving portion 26 of the lid 14. The lid 14 can be removed from the cup body 12 in order to fill the cup body 12 with a desired beverage or if cleaning is needed. In use, the lid 14 has a drinking spout 24 through which combined beverage and medicine can be dispensed through one or more dispensing openings 32 in the drinking spout 24. The drinking spout 24 may be an integrally formed portion of the lid 14 or can be formed separately therefrom. In certain arrangements, the drinking spout 24 may be a straw through which the user dispenses the contents of the drinking cup 10. The medicine and beverage may mix with one another in a portion of the drinking cup 10 that is located between the lower surface of the lid 14 and the upper surface of the flow control element 16. The mixing may take place in a chamber formed due to the presence of the drinking spout 24.

Figure 4:
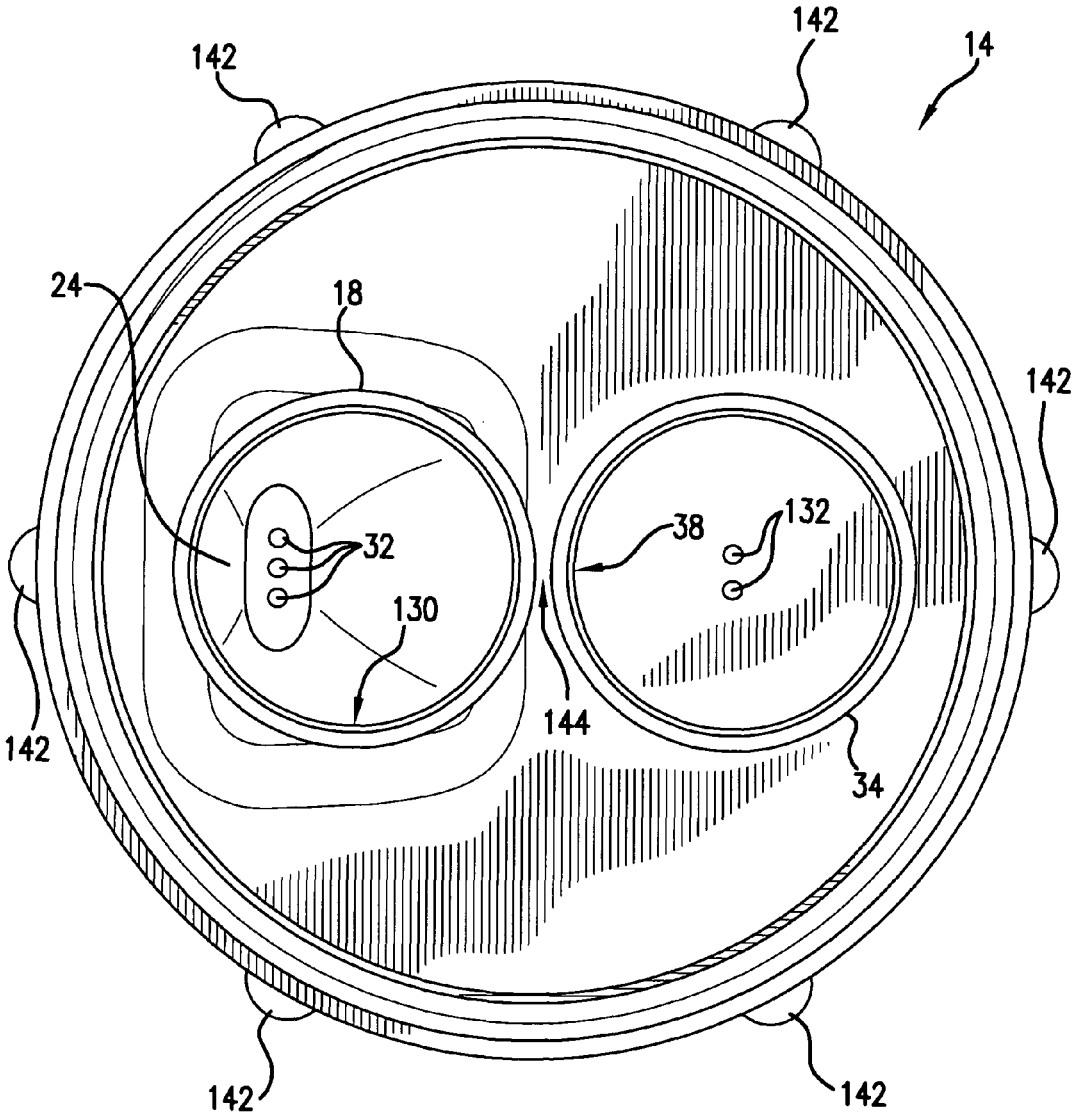
FIG. 4 is a bottom view of the lid of the drinking cup of FIG. 1.

The flow control element 16 is responsible for directing the desired flow of beverage and medicine through the drinking cup 10. The flow control element 16 may be engaged to the lid 14 through a releasable attachment so that these components can be attached and removed by the user as desired. Disengagement may be desired when a user wishes to clean the various components of the drinking cup 10. The lid 14 has a receiving portion 18 that extends downward from a lower surface of the lid 14. The receiving portion 18 may be integrally formed with the other portions of the lid 14 such as the drinking spout 24 or the portions of the lid 14 from which the receiving portion 18 extends. The receiving portion 18 includes a projection receiving surface 20 and a flow control engagement surface 22. In certain arrangements, the projection receiving surface 20 is present and the flow control engagement surface 22 is not present. In yet other exemplary embodiments, the flow control engagement surface 22 is present on the receiving portion 18 and the projection receiving surface 20 is not included. The flow control engagement surface 22 and the projection receiving surface 20 are contiguous with one another such that the projection receiving surface 20 extends from the flow control engagement surface 22. In other embodiments, these two surfaces 20 and 22 are present but are not contiguous with one another such that they do not extend from one another. The receiving portion 18 can have a circular outer perimeter as illustrated in FIG. 4 such that the dispensing openings 32 are located within the outer perimeter of the receiving portion 18 yet displaced upwards in the vertical direction therefrom.

Referring back to FIG. 2, the cross-sectional shape of the receiving portion 18 will now be discussed. The flow control engagement surface 22 has a convex shape from the lowermost portion of the receiving portion 18 to the projection receiving surface 20. However, it is to be understood that other arrangements are possible in which the flow control engagement surface 22 does not have a convex shape but rather is straight, conical, concave, or funnel shaped. In yet other arrangements, a portion of the flow control engagement surface 22 is convex and other portions of the surface 22 are differently shaped such as being straight, concave, funnel, or conical. As such, the flow control engagement surface 22 may be variously shaped in other exemplary embodiments. The projection receiving surface 20 may extend radially outwards from the flow control engagement surface 22 and then may either stop or may extend in the longitudinal direction without extending in the radial direction. As such, the projection receiving surface 20 may be a step of the receiving portion 18 onto which the projection 42 rests and contacts. Alternatively, the projection receiving surface 20 may be both a step and a portion of the inner wall of the receiving portion 18 such that the projection 42 contacts both the step and a portion of the inner wall of the receiving portion 18.

The lid 14 also features a second receiving portion 34. With reference to FIG. 4, the second receiving portion 34 has a circular outer perimeter and is contiguous with the receiving portion 18. One or more vent holes 132 defined through the lid 14 are located within the outer perimeter of the second receiving portion 18 but are spaced upwards vertically therefrom. Referring back to FIG. 2, a portion of the lid 14 extending downwards from the lower surface of the lid 14 defines a portion of both the receiving portion 18 and the second receiving portion 34. The second receiving portion 34 may have a second projection receiving surface 36 and a second flow control engagement surface 38. The surfaces 36 and 38, along with the second receiving portion 34 can be arranged in an identical manner as the surfaces 20 and 22 and receiving portion 18 as previously discussed, and a repeat of this information is not necessary. Also, it is to be understood that the second receiving portion 34 need not be present in accordance with other exemplary embodiments. The receiving portions 18 and 34 may be separated from one another and need not share a common wall. In this regard, the attachment portion 40 having outer perimeter 86 may be distanced so that a space 144 is present between the outer perimeter 120 of the second attachment portion 46. Space 144 may allow the attachment portions 40 and 46 to flex during insertion of the flow control element 16 so that a tighter seal is formed. One or more grips 142 may be included on the lid 14 in order to aid the user in grasping the lid 14 and turning same for removal. The grips 142 can be from 1-4, from 5-8, from 8-15, or up to 20 in number and may be disposed completely about the circumference of the lid 14 and may extend radially outwards from the side of the lid 14.

Figure 2:
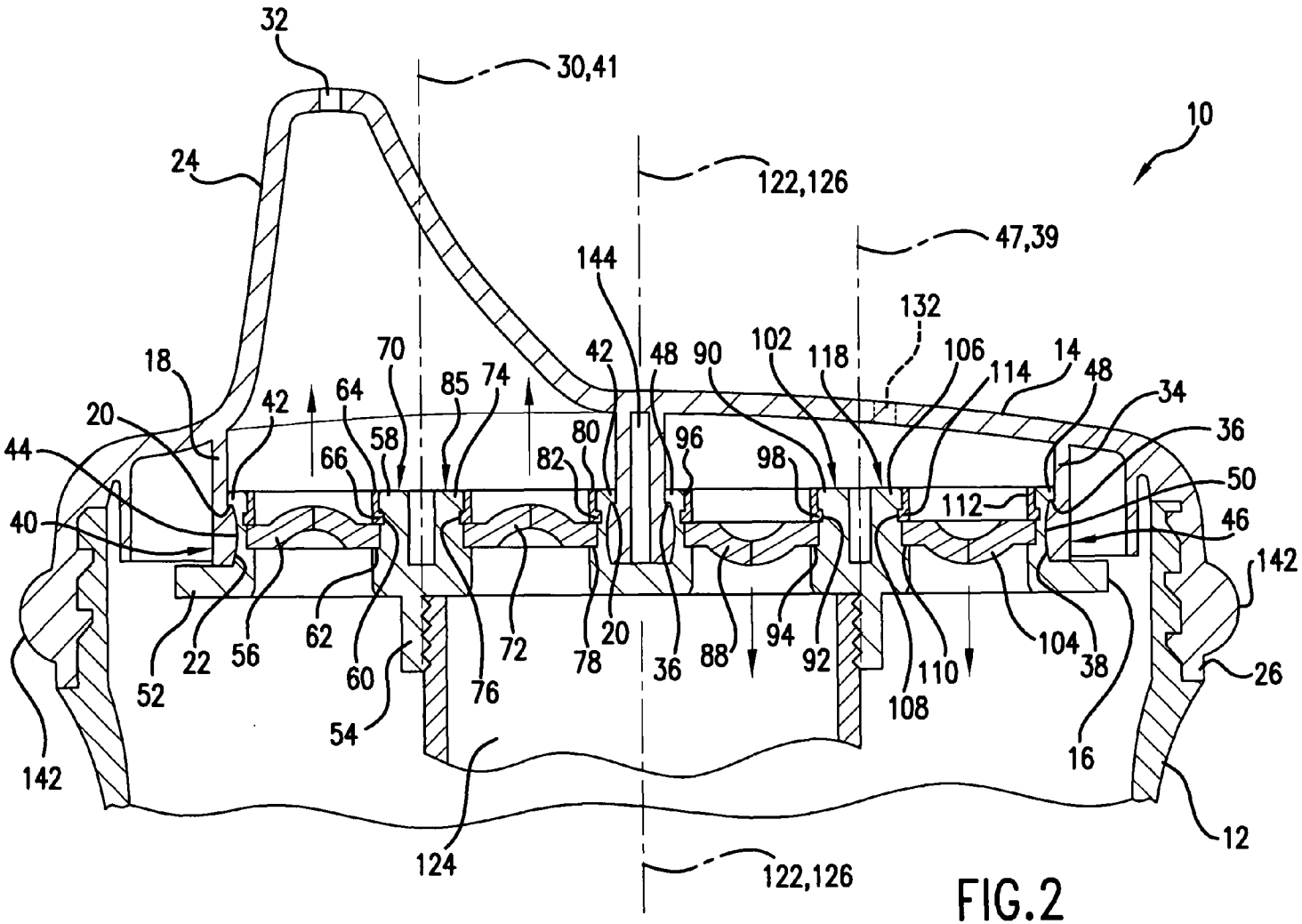
FIG. 2 is a close-up, cross-sectional view of the drinking cup of FIG. 1 that illustrates the releasable attachment arrangement between the flow control element and the lid.
Figure 3:
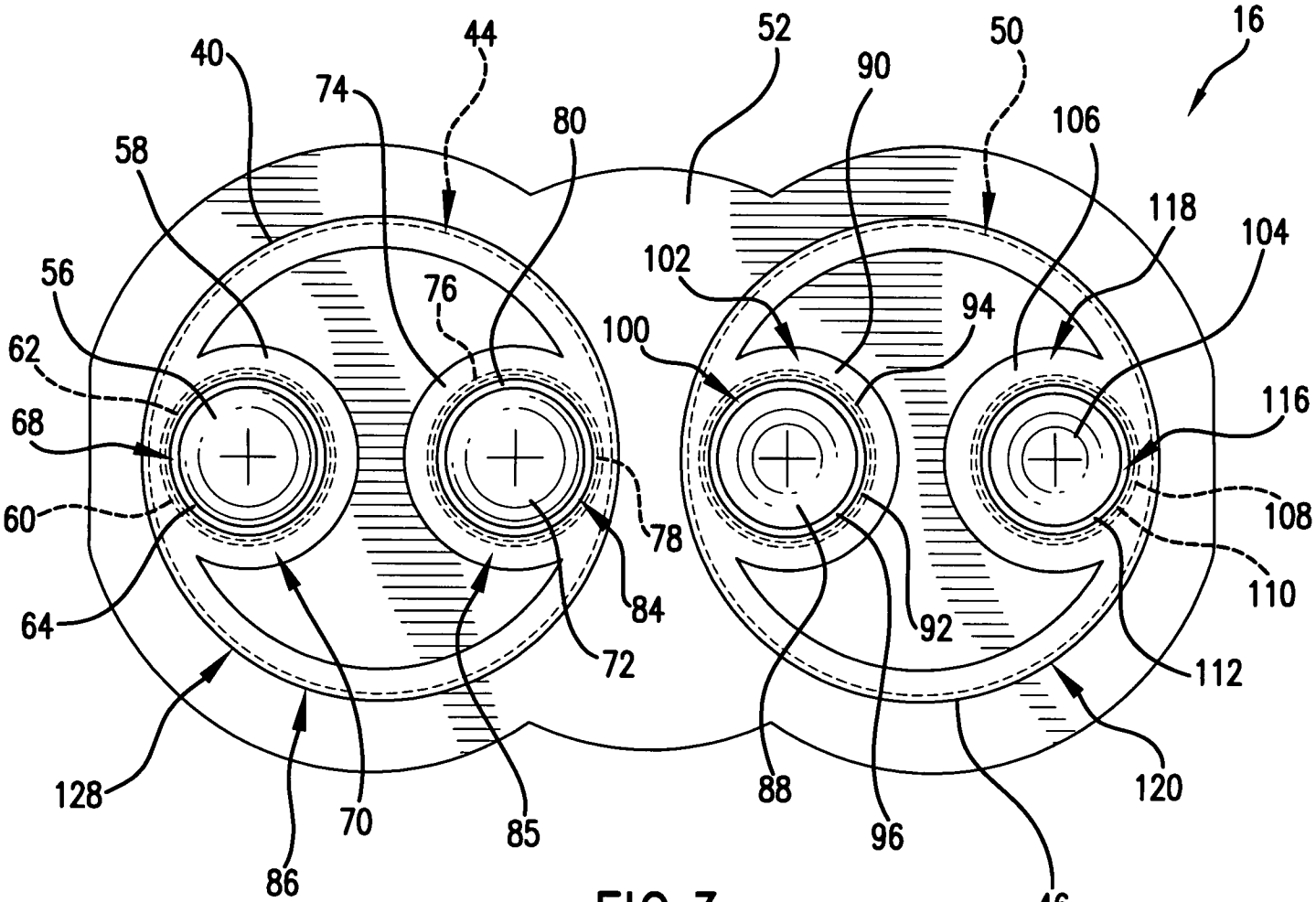
FIG. 3 is a top view of the flow control element of the drinking cup of FIG. 1.

The drinking cup 10 also includes a flow control element 16 that functions to assist the proper flow of beverage and medicine, if present, through the drinking cup 10. With reference to FIGS. 2 and 3, the flow control element 16 has an attachment portion 40 that extends upwards from a base 52. The attachment portion 40 has a circular outer perimeter 86 and is configured for releasable engagement with the receiving portion 18. The attachment portion 40 is shown attached to the receiving portion 18 in FIG. 2. A lid engagement surface 44 is located on the receiving portion 18 and engages the flow control engagement surface 22 of the lid 14. In the exemplary embodiment illustrated, the lid engagement surface 44 is concave in shape. The attachment portion 40 also has a projection 42 that is contiguous with the lid engagement surface 44 and extends therefrom. Projection 42 is received onto the projection receiving surface 20. The projection receiving surface 20 is illustrated as being a step. However, it is to be understood that the projection receiving surface 20 can be variously configured in accordance with other exemplary embodiments.

The entire lid engagement surface 44 from the base 52 to the projection 42 can be concave in shape. However, other arrangements are possible in which only a portion of the lid engagement surface 44 between the base 52 and the projection 42 are concave while the other portion is not concave in shape. The lid engagement surface 44 can be convex, conical, funnel, straight, or variously shaped in accordance with other exemplary embodiments. The projection 42 may extend outward from the lid engagement surface 44 in the radial direction of the attachment portion 40. The projection 42 can extend to such a radial distance that it is located completely radially outward from the entire lid engagement surface 44. In other embodiments, the projection 42 extends radially outward of a majority of the lid engagement surface 44 but not the entire lid engagement surface 44. The projection 42 can extend radially outward from the portion of the lid engagement surface 44 that is contiguous with the projection 42 and hence immediately adjacent the projection 42. In this type of arrangement, the projection 42 may be located radially inwards or at the same position radially with respect to the portion of the lid engagement surface 44 that is adjacent and contiguous with the base 52.

In order to attach the flow control element 16 and the lid 14, the user may align a longitudinal axis 41 of the attachment portion 40 with a longitudinal axis 30 of the receiving portion 18. The user may then push the flow control element 16 and lid 14 so that the projection 42 moves relative to the flow control engagement surface 22. Due to the differences in radial size of these components, the projection 42 will be urged inwards radially as it advances along the flow control engagement surface 22 in a direction generally towards the drinking spout 24. The convex shape of the flow control engagement surface 22 may assist in this insertion as it will facilitate a smooth transition. The attachment portion 40 may be made of a material resilient enough to allow the projection 42 to flex inwardly during this insertion. Once the projection 42 is moved into proximity with the projection receiving surface 20, the radial forces imparted by the flow control engagement surface 22 will be lessened thus allowing the projection 42 to expand outwards in the radial direction and be seated onto the projection receiving surface 20. The projection 42 may snap fit into place once properly positioned. The projection 42 and hence the attachment portion 40 may thus be retained onto the receiving portion 18.

The projection receiving surface 20 and/or the flow control engagement surface 22 may still function to push the attachment portion 40 inwards during this attachment and thus further function to hold the two components together. The convex shape of the flow control engagement surface 22 may be complimentary with the concave shape of the lid engagement surface 44. In this regard, the surfaces 22 and 44 may have the same radii of curvature so that they fit closely against one another during attachment. The entire surfaces 22 and 44 may engage one another, or only portions of the surfaces 22 and 44 may contact one another during attachment in certain exemplary embodiments. The complimentary convex/concave curvature of the surfaces 22 and 44 may likewise function to hold the two components 14 and 16 to one another. The synergistic holding effect of both the projection 42 and surface 20 in combination with the complimentary convex/concave arrangement of surfaces 22 and 44 has been found to effect a surprisingly strong attachment. However, it is to be understood that both of these attachment features need not be present in other arrangements. For example, the projection 42 and surface 20 can be present while the surfaces 22 and 44 are not convex or concave or do not even engage one another.

Once desired, the flow control element 16 and lid 14 can be disengaged from one another through the application of relative force to these components. The user can grasp the base 52 and apply force so as to urge the attachment portion 40 downwards in relation to the receiving portion 18. The projection 42 can be urged out of the projection receiving surface 20 and against the flow control engagement surface 22. This urging will cause the projection 42 to be displaced inwards in the radial direction of the attachment portion 40. The convex shape of the flow control engagement surface 22 will facilitate removal as it acts as a transitional surface to control the radial movement of the projection 42.

The flow control element 16 can also include a second attachment portion 46 that is spaced from the attachment portion 40. The second attachment portion 46 can be seen with reference to FIGS. 2 and 3 and may include a second projection 48 and a second lid engagement surface 50. During attachment, the user can align a longitudinal axis 47 of the second attachment portion 46 to a longitudinal axis 39 of the second receiving portion 34 so that the axes 47 and 39 are coaxial. The second projection 48 and the second lid engagement surface 50 may engage the second projection receiving surface 36 and the second flow control engagement surface 38 during attachment. The second projection 48 and the second lid engagement surface 50 may be configured in a manner similar to that previously discussed with respect to the projection 42 and the lid engagement surface 44 and a repeat of this information is not necessary. As such, the second receiving portion 34 and the second attachment portion 46 function to effectively double the holding power of the flow control element 16 to the lid 14. It is to be understood that the second attachment portion 46 need not be present in other embodiments or can be configured differently from the attachment portion 40 in other arrangements.

The flow control element 16 is present to help direct the flow of beverage and medicine through the drinking cup 10. The flow control element 16 has a valve receiving portion 58 that is used to hold a valve 56. Beverage may be dispensed from the cup body 12 through the valve 56 and into the chamber formed by the drinking spout 24 or likewise at a location between the lid 14 and the flow control element 16. The flow control element 16 has a valve receiving portion 58 that is located within the outer perimeter of the attachment portion 40. The valve receiving portion 58 extends upwards from the base 52 and has a step 62 and a notch 66. The valve 56 rests on the step 62. The valve 56 may be made of a resilient material and can be a one way valve in certain arrangements so that fluid is only capable of moving one way through the valve 56. In yet other arrangements, the valve 56 may be a two way valve so that fluid can move in both directions through the valve 56. A valve retainer 64 is inserted into the valve receiving portion 58 and has a projection 66 that is received with the notch 60 of the valve receiving portion 58. The valve retainer 64 thus functions to hold the valve 56 in place within the valve receiving portion 58. Upon insertion, the upper surface 68 of the valve retainer 64 may be made so as to be flush with the upper surface 70 of the valve receiving portion 58. The valve retainer 64 can be arranged so that a flange is not present such that the valve retainer 64 does not cover a portion of the upper surface 70 and such that the projection 66 extends completely radially beyond any other portion of the valve retainer 64. The outer side surface of the valve retainer 64 may thus have a single, constant dimension in the radial direction except for the projection 66.

With reference now to FIG. 3, the flow control element 16 may have a member that forms both a portion of the valve receiving portion 58 and the attachment portion 40. In other exemplary embodiments, the valve receiving portion 58 can be completely separate from the attachment portion 40. The valve receiving portion 58 may be located within the outer perimeter 86 and may form the highest vertical portion of the flow control element 16. A second valve 72 may be included and can he held onto the flow control element 16 inside of a second valve receiving portion 74. FIG. 2 shows the second valve 72 as being associated with the medicine cup 124 to allow medicine to flow from the medicine cup 124 and into the portion of the drinking cup 10 between the lid 14 and the flow control element 16 to subsequently mix therein with the beverage. The valve 72 may prevent fluid from moving back from this portion into the medicine cup 124. As such, the second valve 72 can be a one way valve in that fluid or air is not allowed to revert back into the medicine cup 124 and can only move one way across the valve 72. The second valve receiving portion 74 may include a notch 76, step 78 and an upper surface 85. Likewise, a second valve retainer 80 may be included to retain the second valve 72 to the second valve receiving portion 74 and can have a projection 82 and an upper surface 84. When assembled, the upper surface 84 can be flush with the upper surface 85. The second valve 72, second valve receiving portion 74, and the second valve retainer 80 and their associated features can be configured in an identical manner as the valve 56, valve receiving portion 58, and valve retainer 64 as previously discussed and a repeat of this information is not necessary.

The flow control element 16 may also include features that allow air to flow into the drinking cup 10 as beverage or medicine is dispensed from the drinking cup 10. Venting of the drinking cup 10 allows for easier dispensing of fluid from the drinking cup 10. The second attachment portion 46 has an outer perimeter 120 that surrounds both a third valve receiving portion 90 and a fourth valve receiving portion 106. The third valve 88 is used to allow air from the vent holes 132 to be transferred into the medicine cup 124 to facilitate transfer of medicine from the medicine cup 124 and prevent a vacuum from forming therein and preventing or hindering dispensing. The third valve 88 may be a one way valve so that medicine is not capable of being transferred across the third valve 88 and into the location illustrated between the lid 14 and the flow control element 16. The third valve receiving portion 90 can include a notch 92 and a step 94, and a third valve retainer 96 may be present with a projection 98. These elements can be configured in a similar manner as those previously discussed with respect to the valve 56, valve receiving portion 58, and valve retainer 64 and a repeat of this information is not necessary. Further, when assembled the upper surface 100 of the third valve retainer 96 can be flush with the upper surface 102 of the third valve receiving portion 90.

A fourth valve 104 may be included in the drinking cup 10 and can be used to allow air from the vent holes 132 to be transferred into the cup body 12 so that beverage in the cup body 12 can be more easily dispensed therefrom through valve 56. The fourth valve 104 may be a one way valve to prevent beverage from being dispensed through the fourth valve 104 and into the location between the lid 14 and the flow control element 16. The fourth valve receiving portion 106 may include a notch 108 and a step 110. A fourth valve retainer 112 may likewise be present to effect attachment of the fourth valve 104 to the fourth valve receiving portion 106 and can include a projection 114. The fourth valve 104, fourth valve receiving portion 106, and fourth valve retainer 112 can be arranged in a manner similar to the valve 56, valve receiving portion 58, and valve retainer 64 as discussed above and a repeat of this information is not necessary. The upper surface 116 of the fourth valve retainer 112 can be flush with the upper surface 118 of the fourth valve receiving portion 106. In accordance with certain exemplary embodiments, the upper surfaces 70, 85, 102 and 118 may be located at the same vertical height as one another and may be the highest vertical surfaces of the flow control element 16. The upper surfaces 68, 84, 100 and 116 may be located at the same vertical height and at a vertical height below the surfaces 70, 85, 102 and 118 or may be located flush and hence as the same vertical height as surfaces 70, 85, 102 and 108. In other exemplary embodiments, the surfaces 68, 84, 100 and 116 may be located at the same vertical height as one another and may be at a vertical height above the upper surfaces 70, 85, 102, and 118 and hence may be the highest vertical surfaces of the flow control element 16.

The flow control element 16 may include a medicine cup receiving portion 54 that extends downwards from the base 52 so as to be on the opposite side of the base 52 as the attachment portion 40 and the second attachment portion 46. The medicine cup receiving portion 54 can include internal threading that engages external threading of the medicine cup 124 so as to effect attachment. The user may unscrew the medicine cup 124 to detach same from the medicine cup receiving portion 54 when desired to fill the medicine cup 124 or to clean the medicine cup 124. Although shown as being releasably attached through the use of a threaded connection, the medicine cup 124 can be releasably attached to the flow control element 16 through the use of a projection and concave/convex surfaces in a manner as previously discussed with respect to the receiving portion 18 and the attachment portion 40.

Figure 5:
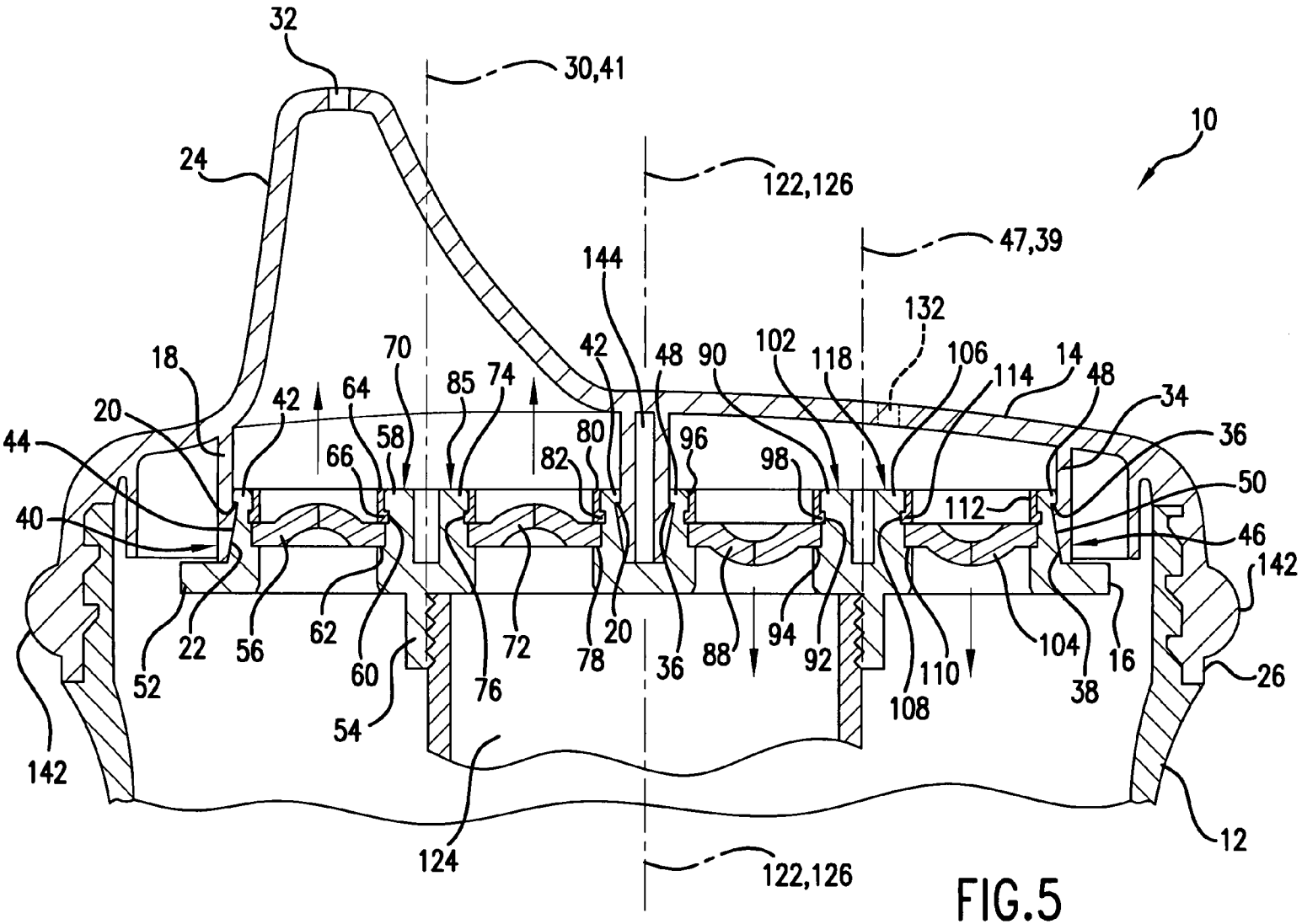
FIG. 5 is a close-up cross-sectional view of the releasable attachment arrangement between the flow control element and the lid in accordance with another exemplary embodiment.

An alternative exemplary embodiment of the drinking cup 10 is illustrated in FIG. 5. Here, the attachment portion 40 is arranged so that the lid engagement surface 44 is cone shaped and has a consistent angular orientation from the base 52 to the projection 42. The lid engagement surface 44 thus does not have a concave or a convex shape but rather has a cone shaped surface that has the same line of inclination throughout its entire length. The projection 42 extends outwards radially from the lid engagement surface 44 so as to extend radially beyond at least a portion of the lid engagement surface 44. In other arrangements, the projection 42 may extend radially beyond the entire lid engagement surface 44 or a majority of the lid engagement surface 44. The flow control engagement surface 22 has a funnel shape and does not have a convex or a concave shape. The flow control engagement surface 22 has a shape that is complimentary to the lid engagement surface 44 such that the flow control engagement surface 22 engages the lid engagement surface 44 along its entire length when the flow control element 16 is attached to the lid 14. The bottom surface of the receiving portion 18 engages the top surface of the base 52. Further, the projection 42 engages a projection receiving surface 20 when the flow control element 16 is attached. Attachment is effected in a similar manner as previously discussed in that the flow control element 16 is inserted into the lid 14 and the projection 42 is urged radially inwards as it moves upwards across the flow control engagement surface 22. Once the projection 42 encounters the projection receiving surface 20, the radially inward force on the projection 42 ceases and the projection 42 expands or snaps outwards onto the flow control engagement surface 22. The attachment portion 40 can be secured through either the engagement with the projection 42 to the projection receiving surface 20, or through the engagement between the cone shaped lid engagement surface 44 and the funnel shaped flow control engagement surface 22, or through the combination of these features. When removal is desired, the user can urge the flow control element 16 apart from the lid 14 so that the projection 42 is forced radially inwards upon being urged vertically downwards and against the flow control engagement surface 22.

Figure 6:
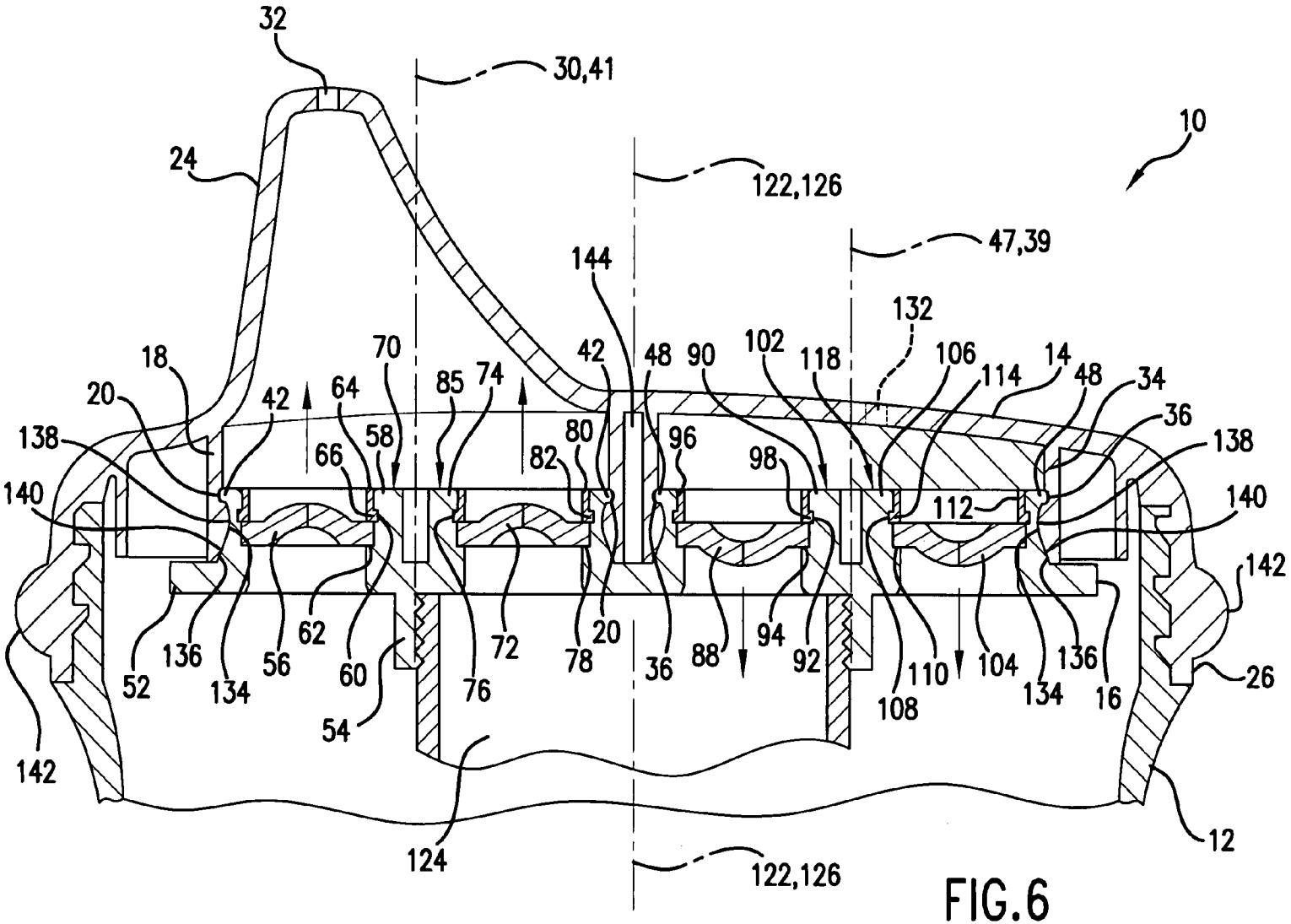
FIG. 6 is a close-up, cross-sectional view of the releasable attachment arrangement between the flow control element and the lid in accordance with yet another exemplary embodiment.

Another alternative exemplary embodiment is illustrated in FIG. 6. Here, the lid engagement surface 44 has a conical portion 136 that is contiguous with and extends from the base 52, and a concave portion 134 that is contiguous with the conical portion 136 and extends therefrom to the projection 42. The flow control engagement surface has a funnel portion 140 that is complimentary with the conical portion 136 and that engages the conical portion 136 during attachment. The funnel portion 140 extends from the bottom of the receiving portion 18. The flow control engagement surface 22 also includes a convex portion 138 that is contiguous with the funnel portion 140 and that engages the concave portion 134 during attachment. The concave portion 134 and convex portion 138 have shapes that are complimentary to one another and thus fully engage one another during attachment.

The projection receiving surface 20 is a notch into which the projection 42 is inserted during attachment. The notch 20 thus extends around more than 180° of the outer surface of the projection 42 that has a circular cross-sectional shape. The notch 20 may thus engage a portion of the bottom, side, and top surfaces of the projection 42. The projection receiving surface 20 can be sized so as to tightly receive the projection 42 such that the projection 42 snap fits into the notch 20. Disengagement of the flow control device 16 may be effected in a similar manner as previously discussed.

The variously exemplary embodiments presented show the lid engagement surface 44 and the projection 42 on an outer surface 128 of the attachment portion 40, and the flow control engagement surface 22 and the projection receiving surface 20 on the inner surface 130 of the receiving portion 18. As such, to effect attachment, the outer surface 128 of the attachment portion 40 engages the inner surface 130 of the receiving portion 18. However, it is to be understood that other exemplary embodiments are possible in which the inner surface of the attachment portion 40 engages the outer surface of the receiving portion 18 to effect releasable attachment. In such arrangements, the aforementioned surfaces may have a convex or concave shape and may or may not include a projection to effect the releasable attachment. Further, although shown as being on the attachment portion 40, the projection 42 may be on the receiving portion 18 in other arrangements and the projection receiving surface 20 can be located on the attachment portion 40. Likewise, the projection 42 need not be located at the upper portion of the attachment portion 40 in other exemplary embodiments. For example, the projection 42 may be located proximate the base 52 or may be located intermediate the base 52 and the upper surface of the attachment portion 40 in accordance with other exemplary embodiments. In certain exemplary embodiments, both the flow control engagement surface 22 and the lid engagement surface 44 are both straight surfaces and are not convex, concave, conical, or funnel shaped. The flow control element 16 may be attached through the use of the projection 42 received onto the projection receiving surface 20 with minimal or no frictional engagement between the flow control engagement surface 22 and the lid engagement surface 44.

Figure 7:
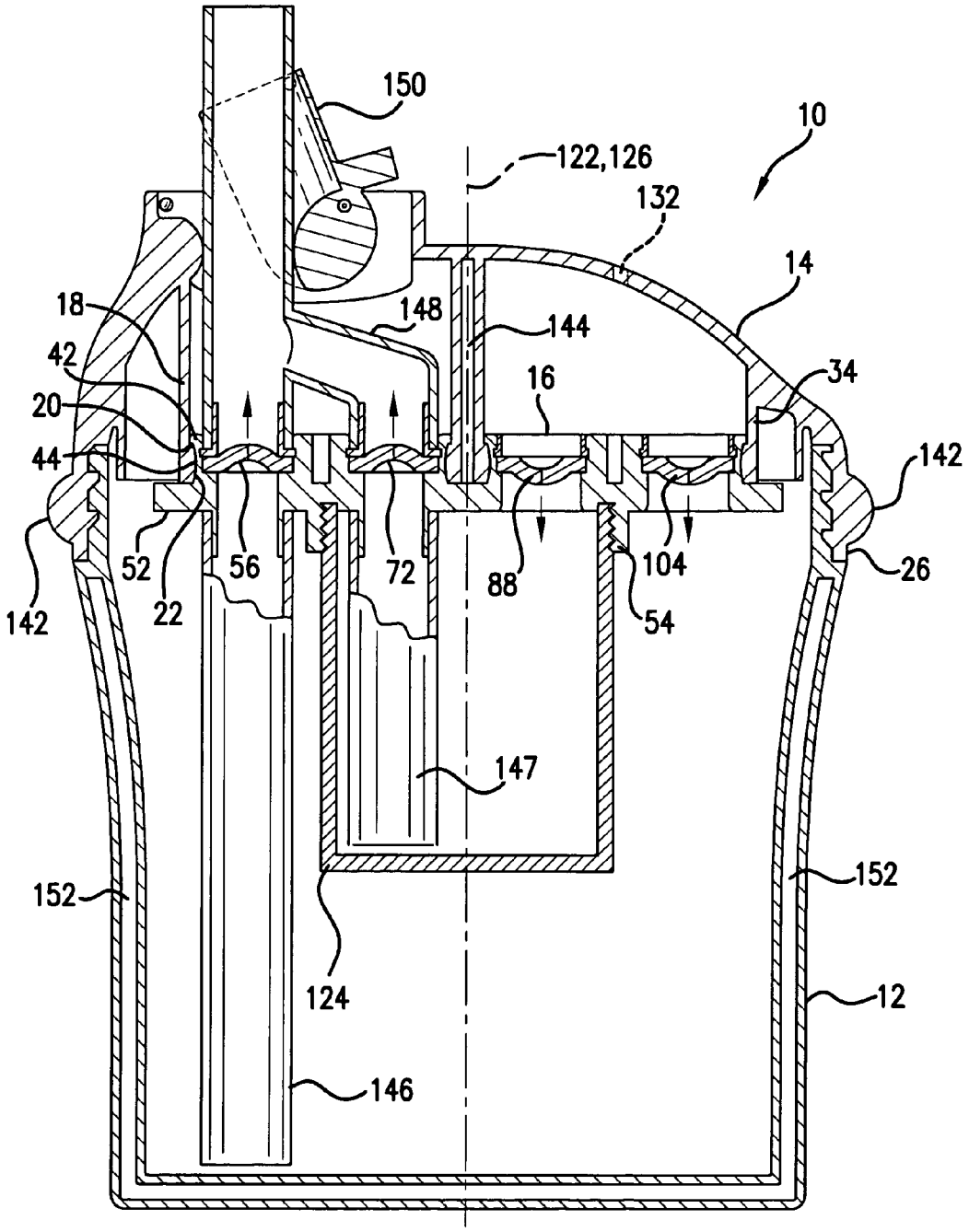
FIG. 7 is a cross-sectional view of a drinking cup in accordance with another exemplary embodiment.

An alternative exemplary embodiment of the drinking cup 10 is disclosed in FIG. 7. Here, the cup body 12 is double walled so that a space 152 is present between the two walls of the cup body 12. Space 152 functions as an insulator to inhibit heat flow through the cup body 12. The space 152 may be completely empty or may include some type of additional insulation in accordance with other embodiments. The arrangement in FIG. 7 has a first straw 146 that extends from the flow control element 16 below the valve 56. The flow control element 16 may have projections extending therefrom around which the first straw 146 is seated and retained via a frictional fit. The first straw 146 is used to pull fluid from the cup body 12 and then through the valve 56. A second straw 147 is located in the medicine cup 124 and is likewise attached to the flow control element 16. The second straw 147 may be frictionally fit into a projection of the flow control element 16. In other arrangements, the first and second straws 146 and 147 may be retained by being forced inside of a projection of the flow control element 16 rather than around such projections. Medicine from the medicine cup 124 is pulled through the second straw 147 and through the second valve 72. A third straw 148 likewise extends from the flow control element 16 and is located above the valves 56 and 72 so that flow exiting the valves 56 and 72 flow into the third straw 148. The third straw 148 is branched so that fluid exiting valve 56 mixes with fluid exiting second valve 72. The third straw 148 may be a single component or may be made of multiple components that are joined together. The third straw 148 may be arranged so that it is frictionally fit around a projection of the flow control element 16 at the valve 56 and frictionally fit around a projection of the flow control element 16 at the valve 72. It is to be understood that various arrangements are possible for effecting attachment of the straws 146, 147 and 148 to the flow control element 16 and that the disclosed arrangements are only exemplary.

A straw closing mechanism 150 is included on the lid 14 and functions to close the third straw 148 when moved from an open to a closed position. The straw closing mechanism 150 in the closed position completely covers the tip of the third straw 148 and may in some arrangements function to pinch the tip of the third straw 148. In this regard, a ridge or bump may be provided on the lid 14 and the turning of the straw closing mechanism 150 will cause the third straw 148 to be moved over the bump and hence pinched between the bump and the straw closing mechanism 150. This pinching may function to both seal the third straw 148 and pull the third straw 148 into the cavity of the straw closing mechanism 150.

Further, although shown as employing four valves 56, 72, 88, and 104, it is to be understood that any number of valves may be included in other embodiments. For example, the drinking cup 10 may include but a single valve, from 2-5 valves, from 4-6 valves, or up to 10 valves in accordance with other exemplary embodiments. The drinking cup 10 may be provided with one or more handles to assist the user in holding the drinking cup 10 during use. The handle may extend from the cup body 12 and may be variously configured.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A drinking cup, comprising:

a lid having a receiving portion, wherein the receiving portion has a projection receiving surface and a flow control engagement surface that extends from the projection receiving surface;

a flow control element having an attachment portion that has a longitudinal axis that extends in a longitudinal direction, wherein the attachment portion has a projection and a lid engagement surface that extends from the projection, wherein the flow control element has a base and wherein the lid engagement surface is between the projection and the base in the longitudinal direction, wherein the flow control element is configured for releasable attachment with the lid, wherein when the flow control element and the lid are attached the flow control engagement surface engages the lid engagement surface, and wherein when the flow control element and the lid are attached the projection engages the projection receiving surface; and a valve carried by the flow control element;

wherein the projection is located radially outward from the lid engagement surface and is located on a terminal end of the flow control element that directly faces the lid, wherein the valve is located within a footprint of the perimeter of the projection, wherein the receiving portion is located radially outward from the projection.

2. The drinking cup as set forth in claim 1, wherein the lid has a dispensing opening, wherein the projection receiving surface is located closer to the dispensing opening than the flow control engagement surface, and wherein the projection is located closer to the dispensing opening than the lid engagement surface when the lid and the flow control element are attached.

3. The drinking cup as set forth in claim 1, wherein the receiving portion has a longitudinal axis, and wherein the longitudinal axis of the attachment portion is coaxial with the longitudinal axis of the receiving portion when the lid and the flow control element are attached, wherein the projection and the lid engagement surface are contiguous with one another and wherein the projection is located radially outward from at least a majority of the lid engagement surface.

4. The drinking cup as set forth in claim 1, wherein at least a majority of the lid engagement surface is concave in shape, wherein at least a majority of the flow control engagement surface is convex in shape, and wherein the portion of the lid engagement surface that is concave in shape is complimentary in shape to the portion of the flow control engagement surface that is convex in shape.

5. The drinking cup as set forth in claim 1, wherein the flow control element has a valve receiving portion that has an upper surface and a notch and a step, wherein the valve engages the step; and further comprising a valve retainer that engages the valve and that has a projection that is disposed within the notch, wherein the valve retainer has an upper surface that is flush with the upper surface of the valve receiving portion.

6. A drinking cup, comprising:

a lid having a receiving portion, wherein the receiving portion has a projection receiving surface and a flow control engagement surface that extends from the projection receiving surface;

a flow control element having an attachment portion that has a longitudinal axis, wherein the attachment portion has a projection and a lid engagement surface that extends from the projection, wherein when the flow control element and the lid are attached the flow control engagement surface engages the lid engagement surface, and wherein when the flow control element and the lid are attached the projection engages the projection receiving surface; and a valve carried by the flow control element; wherein the projection is located radially outward from the lid engagement surface and is located on a terminal end of the flow control element that directly faces the lid, wherein the valve is located within a footprint of the perimeter of the projection;

wherein the lid has a second receiving portion that has a second projection receiving surface and a second flow control engagement surface that extends from the second projection receiving surface;

wherein the flow control element has a second attachment portion that has a second projection and a second lid engagement surface that extends from the second projection, wherein when the flow control element and the lid are attached the second flow control engagement surface engages the second lid engagement surface, and wherein when the flow control element and the lid are attached the second projection engages the second projection receiving surface;

wherein the flow control element has a valve receiving portion that receives the valve;

further comprising:

a second valve, wherein the flow control element has a second valve receiving portion that receives the second valve, wherein the attachment portion has a circular outer perimeter and wherein both the valve receiving portion and the second valve receiving portion are located within the outer perimeter of the attachment portion;

a third valve, wherein the flow control element has a third valve receiving portion that receives the third valve;

a fourth valve, wherein the flow control element has a fourth valve receiving portion that receives the fourth valve, wherein the second attachment portion has a circular outer perimeter and wherein both the third and fourth valve receiving portions are located within the outer perimeter of the second attachment portion;

a cup body that is configured for releasable attachment to the lid, wherein the cup body has a longitudinal axis that extends through the center of the cup body; and a medicine cup that is configured for releasable attachment to the flow control element, wherein the medicine cup has a longitudinal axis that extends through the center of the medicine cup, wherein when the medicine cup is attached to the flow control element and when the flow control element is attached to the lid the longitudinal axis of the cup body and the longitudinal axis of the medicine cup are coaxial.

7. A drinking cup, comprising:

a lid having a receiving portion, wherein the receiving portion has a flow control engagement surface;

a flow control element having an attachment portion, wherein the attachment portion has a lid engagement surface that has a concave shape, wherein the flow control element is configured for releasable attachment with the lid, wherein when the flow control element and the lid are attached the flow control engagement surface engages the lid engagement surface; and a valve carried by the flow control element;

a valve retainer that engages both the valve and the flow control element and retains the valve to the flow control element, wherein the valve also separately engages the flow control element, wherein the lid engagement surface has a concave shape that has a perimeter, and wherein the valve is located within a footprint of the perimeter of the lid engagement surface that has the concave shape, wherein the concave shape of the lid engagement surface is oriented to face radially outward.

8. The drinking cup as set forth in claim 7, wherein the entire lid engagement surface has a concave shape.

9. The drinking cup as set forth in claim 7, wherein the flow control engagement surface has a convex shape that is complimentary to the concave shape of the lid engagement surface.

10. The drinking cup as set forth in claim 7, wherein the receiving portion of the lid has a projection receiving surface that extends from the flow control engagement surface, wherein the attachment portion of the flow control element has a projection that extends from the lid engagement surface, wherein when the flow control element and the lid are attached the projection engages the projection receiving surface.

11. The drinking cup as set forth in claim 10, wherein the lid has a dispensing opening and wherein the projection receiving surface is a step, wherein the projection receiving surface is located closer to the dispensing opening than the flow control engagement surface.

12. A drinking cup, comprising:

a valve;

a lid having a receiving portion, wherein the receiving portion has a flow control engagement surface; and a flow control element having an attachment portion, wherein the attachment portion has a lid engagement surface, wherein the flow control element is configured for releasable attachment with the lid, wherein when the flow control element and the lid are attached the flow control engagement surface engages the lid engagement surface, wherein one of the flow control engagement surface and the lid engagement surface has a concave shape that extends about a perimeter, wherein the valve is located within a footprint of the perimeter of the concave shape, and wherein the concave shape extends to a lower terminal end of the receiving portion;

wherein the other one of the flow control engagement surface and the lid engagement surface has a convex shape that engages the counterpart concave shaped surface, wherein the convex and concave shaped surfaces extend gradually inward and outward in a radial direction upon their extension in a longitudinal direction of the drinking cup.

13. The drinking cup as set forth in claim 10, wherein the lid engagement surface is on an outer surface of the attachment portion and is concave in shape, wherein the flow control engagement surface is on an inner surface of the receiving portion and is convex in shape and has a shape complimentary to the concave shape of the lid engagement surface.

14. The drinking cup as set forth in claim 13, wherein the attachment portion has a projection that extends from the lid engagement surface, wherein the receiving portion has a projection receiving surface that extends from the flow control engagement surface, wherein when the flow control element and the lid are attached the projection engages the projection receiving surface, wherein the projection is located radially outwards from at least a majority of the lid engagement surface.

15. A drinking cup, comprising:

a valve;

a lid having a receiving portion, wherein the receiving portion has a flow control engagement surface; and a flow control element having an attachment portion wherein the attachment portion has a lid engagement surface, wherein the flow control element is configured for releasable attachment with the lid, wherein when the flow control element and the lid are attached the flow control engagement surface engages the lid engagement surface, wherein at least one of the flow control engagement surface and the lid engagement surface has a concave shape that extends about a perimeter, wherein the valve is located within a footprint of the perimeter of the concave shape, and wherein the concave shape extends to a lower terminal end of the receiving portion;

wherein the lid engagement surface is on an outer surface of the attachment portion and is concave in shape, wherein the flow control engagement surface is on an inner surface of the receiving portion and is convex in shape and has a shape complimentary to the concave shape of the lid engagement surface;

wherein the attachment portion has a projection that extends from the lid engagement surface, wherein the receiving portion has a projection receiving surface that extends from the flow control engagement surface, wherein when the flow control element and the lid are attached the projection engages the projection receiving surface, wherein the projection is located radially outwards from at least a majority of the lid engagement surface:

wherein the projection receiving surface is a notch.

* * * * *